US009032894B2

(12) United States Patent
Frejaville et al.

(10) Patent No.: US 9,032,894 B2
(45) Date of Patent: May 19, 2015

(54) MARINE OR UNDERWATER VEHICLE AND ASSOCIATED SECURING METHOD

(75) Inventors: Eric Frejaville, Sollies Pont (FR); Gerard Mothier, La Garde (FR)

(73) Assignee: ECA ROBOTICS, La Garde (FR)

( * ) Notice: Subject to any disclaimer, the term of this patent is extended or adjusted under 35 U.S.C. 154(b) by 275 days.

(21) Appl. No.: 13/557,389

(22) Filed: Jul. 25, 2012

(65) Prior Publication Data

US 2013/0025523 A1 Jan. 31, 2013

(30) Foreign Application Priority Data

Jul. 26, 2011 (FR) ..... 11 56819

(51) Int. Cl.

| | |
|---|---|
| ***B63B 21/58*** | (2006.01) |
| ***B63B 21/66*** | (2006.01) |
| ***B63B 27/18*** | (2006.01) |
| ***B63C 11/42*** | (2006.01) |
| ***B63G 8/42*** | (2006.01) |
| *B63G 8/00* | (2006.01) |

(52) U.S. Cl.

CPC ..... *B63G 8/001* (2013.01); *B63B 21/58* (2013.01); *B63B 21/66* (2013.01); *B63B 27/18* (2013.01); *B63C 11/42* (2013.01); *B63G 8/42* (2013.01)

(58) Field of Classification Search

CPC ..... B63G 8/00; B63G 8/001; B63G 8/42; B63B 21/58; B63B 21/60; B63B 21/66; B63B 27/18; B63B 21/56; B63C 11/42; B63C 7/00

USPC ..... 114/249, 312, 313, 322

See application file for complete search history.

(56) References Cited

U.S. PATENT DOCUMENTS

| | | | | |
|---|---|---|---|---|
| 4,686,927 | A * | 8/1987 | Hawkes et al. | 114/312 |
| 6,904,856 | B2 * | 6/2005 | Wallace | 114/51 |
| 7,025,014 | B1 * | 4/2006 | Forgach et al. | 114/244 |
| 2008/0302292 | A1 | 12/2008 | Ruggaber | |

FOREIGN PATENT DOCUMENTS

| | | |
|---|---|---|
| FR | 1061211 | 4/1954 |
| GB | 2239632 | 7/1991 |
| WO | 0121476 | 3/2001 |

OTHER PUBLICATIONS

French Search report dated Apr. 13, 2012, in corresponding French Application FR1156819.

* cited by examiner

*Primary Examiner* — Daniel V Venne

(74) *Attorney, Agent, or Firm* — Young & Thompson

(57) ABSTRACT

Marine or underwater vehicle designed to be secured to a recovery cable includes contactless elements (6) for detecting the recovery cable (2), the element being capable of guiding the vehicle (1) towards the cable (2) and elements (7) situated at one end (3*b*) of the vehicle (1) for coupling the cable (2).

11 Claims, 4 Drawing Sheets

MARINE OR UNDERWATER VEHICLE AND ASSOCIATED SECURING METHOD

The present invention relates to the field of underwater or marine vehicles, in particular a device for securing such a vehicle.

A particularly worthwhile application of the invention relates to the recovery of a submersible vehicle by a pulling cable, in order to be returned to the water surface, for example to the deck of a ship, either directly or by means of a movable receiving portion. The invention also relates to the recovery of a submersible vehicle by a pulling cable in order to be recovered for example by a submarine.

BACKGROUND OF THE INVENTION

An autonomous submersible vehicle, also called an "AUV" (Autonomous Underwater Vehicle), is usually recovered by winching means attached to a naval surface vehicle and a movable portion for receiving the vehicle. More particularly, the movable portion, usually called a "cage" comprises a frame defining a housing into which the vehicle can travel in order to be recovered.

Document WO 01/21476 describes a submersible apparatus for launching, maintenance and recovery of a submersible vehicle notably comprising a recovery platform comprising a first connection to a surface vehicle and a second connection to a submersible vehicle. The submersible vehicle for this purpose comprises a connection means of a complementary shape for connection to the second connection of the recovery platform. Such a recovery device is complex and does not allow an effective coupling of the marine vehicle to a pulling cable.

Specifically, when there are heavy swells, such a coupling system is difficult to achieve.

It is also possible to refer to document US 2008/0302292 which describes an apparatus for recovering a submersible vehicle comprising a body formed of a plurality of telescopic tubes connected to a cone for receiving the submersible vehicle that clamps on the cylindrical front surface of the vehicle. One of the telescopic tubes is then retracted in order to recover the vehicle into the recovery apparatus.

However, it is necessary to properly align the vehicle with the receiving cone so that the latter can be properly recovered into the recovery apparatus.

Such devices are not suitable in the event of rough sea, because of movements of the recovery means that are generated by the swell and that would prevent the submersible vehicle from being suitably recovered without being damaged.

Moreover, none of these documents proposes a submersible vehicle capable of being secured autonomously to a pulling cable.

SUMMARY OF THE INVENTION

The object of the present invention is to alleviate the drawbacks of the prior art.

The object of the invention is to propose a submersible vehicle comprising its own securing means in a marine environment in order to be autonomous while being coupled effectively to a recovery cable which may be a pulling cable and while preventing the influence of the vertical movements due to the swell.

The subject of the invention is a marine or underwater vehicle designed to be secured to a recovery cable. The vehicle comprises a contactless means for detecting the recovery cable, the said means being capable of detecting the cable and of guiding the vehicle towards the cable and means located on the vehicle for coupling the cable.

Thus, the marine or underwater vehicle finds the cable by detection and is then guided by its own detection means towards a pulling cable which may be ballasted, the cable is then effectively locked to the vehicle by virtue of coupling means situated at the front of the vehicle. The vehicle thus secured may, for example, then be pulled into a movable portion such as a receiving cage or directly onto a ramp in order to be raised, if it is submerged, to the surface of the water.

Advantageously, the coupling means are situated at one end of the vehicle, but may also be located on the outer surface of the body of the vehicle.

Advantageously, the coupling means comprise at least one hook and at least gripper or clamp that is able to rotate between a closed position in contact with the outer surface of the vehicle, an open position separating from the outer surface of the vehicle in order to offer a wide opening for receiving the cable and a coupling position in which the gripper interacts with the hook in order allow a space to subsist for the passage of the cable between the gripper and the outer surface of the marine vehicle.

For example, the gripper comprises a portion for detection of the cable by contact.

The coupling means may comprise at least one locking clapper situated in the hook for the passage of the cable.

Advantageously, the marine vehicle comprises an electronic control unit capable of directing the marine vehicle towards the pulling cable as a function of the contactless detection means, of controlling the position of the gripper as a function of the data supplied by the portion for detection by contact, and of locking the clapper after the passage of the cable.

The vehicle may comprise one or more grippers judicially situated on the vehicle.

The vehicle is, for example, autonomous and comprises internal propulsion means.

Advantageously, the contactless detection means comprise at least one sensor which may be acoustic (for example a sonar), laser or video.

According to another aspect, the invention relates to a method for coupling a marine vehicle to a recovery cable in which the cable is detected and the marine vehicle is guided to the cable by contactless detection means or the cable is coupled by coupling means which may be situated at one end or on the sides of the marine vehicle.

Advantageously, when the cable is detected by the contactless detection means, a gripper is actuated into an open position separating from the outer surface of the vehicle.

When the cable is detected by means for detection by contact situated on the gripper, it is possible to actuate the gripper into a coupling position in which the gripper interacts with a hook in order to allow a space to subsist for the passage of the cable between the gripper and the outer surface of the marine vehicle.

Moreover, when the cable is in the space between the gripper and the outer surface of the marine vehicle, the cable is allowed to slip towards a locking clapper situated in the hook and the cable is locked by locking the clapper.

BRIEF DESCRIPTION OF THE DRAWINGS

Other objects, features and advantages of the invention will appear on reading the following description, given only as a non-limiting example, and made with reference to the appended drawings in which.

DETAILED DESCRIPTION OF THE PREFERRED EMBODIMENTS

Figure 1:
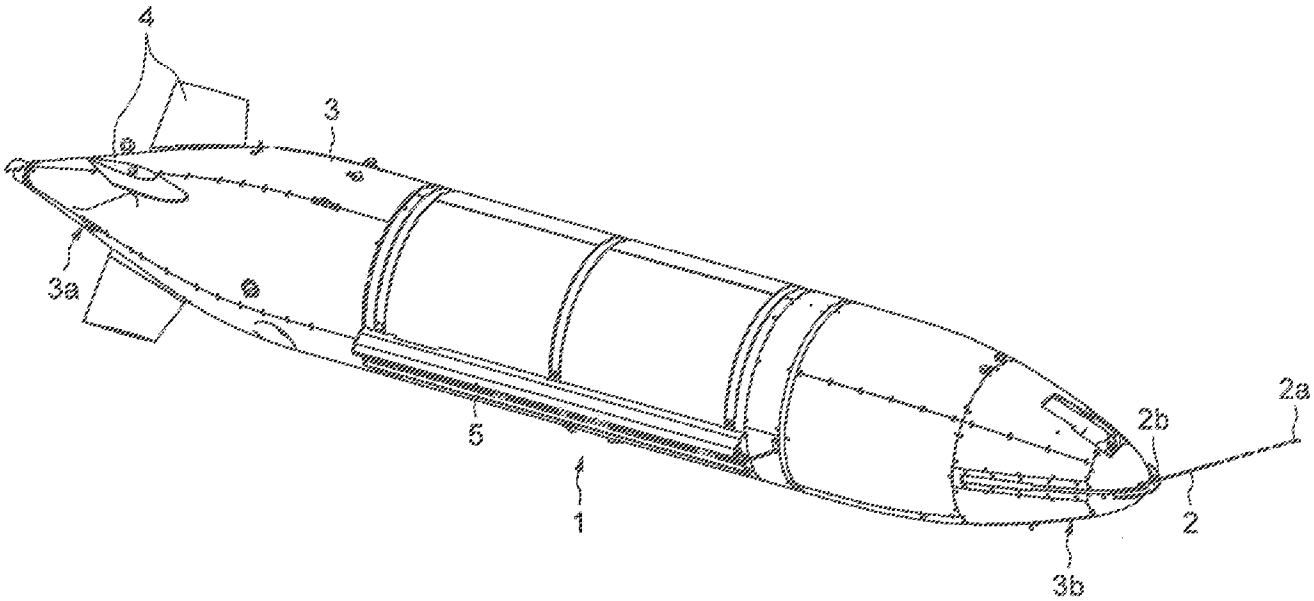
FIG. 1 is a general view of a marine vehicle recovered by a pulling cable.
Figure 2:
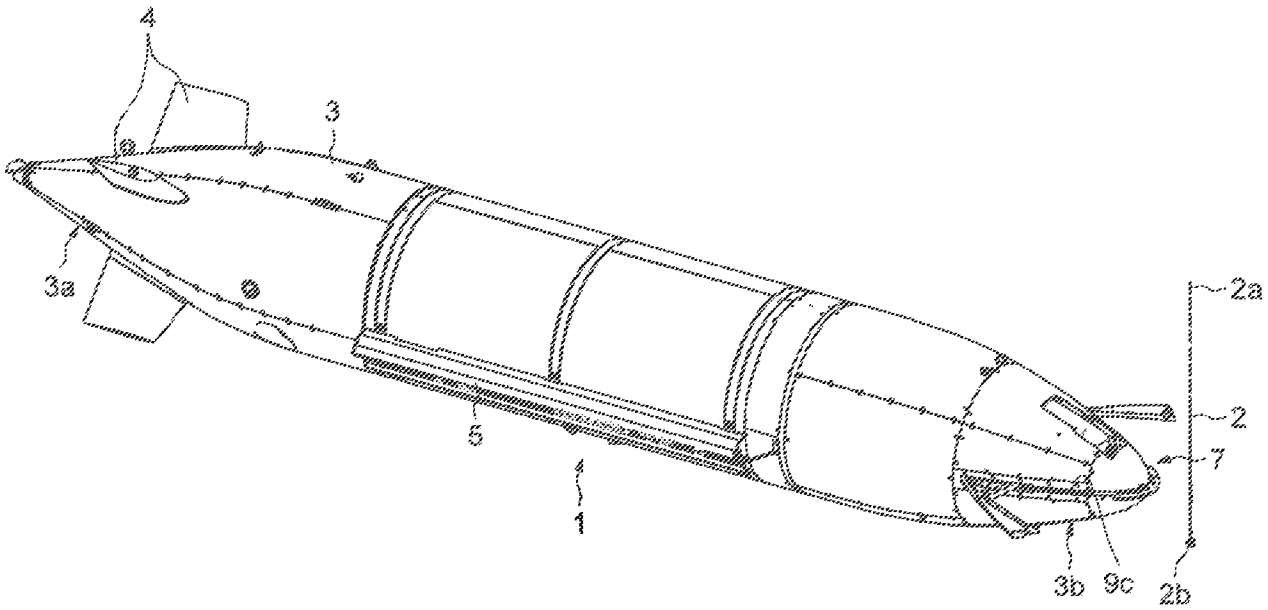
FIG. 2 is a general view of the marine vehicle for the purpose of being recovered by the pulling cable.

As illustrated in FIGS. 1 and 2, a marine or underwater vehicle, reference 1 in its entirety, is designed to be recovered by a recovery device (not shown) connected for example by lifting cables to a surface craft or naval vehicle (not shown). The recovery device comprises, for example, a movable portion (not shown), such as a receiving cage and a pulling cable 2 of which a first end 2*a* is connected to a front end of the receiving cage, for example to a traction winch (not shown) and a second free end 2*b* designed to be coupled by the vehicle 1.

The receiving cage, described in French Patent Application No. 1061211, will not be described further in the present application.

It will be noted that the invention is not limited to the use of such a receiving cage in order to recover the marine vehicle. Any other means for recovering a marine vehicle by using a pulling cable may be used, notably the recovery of the vehicle by a submersible.

The vehicle 1 may, for example, be a submersible underwater or floating vehicle and be designed, for example, to carry out underwater supervision and/or inspection. The underwater vehicle 1 extends along a longitudinal axis and comprises a main body 3 of generally cylindrical or torpedo shape. The body 3 has fins 4 attached to a rear end 3*a* and provided for ensuring the stability of the movement of the vehicle 1, propulsion elements 5 attached on one side and the other of the body 3 in front of the fins 4. The vehicle 1 also comprises a front portion 3*b* that can, for example, comprise a camera (not shown) for observing sea beds. The vehicle 1 is thus autonomous and comprises its own internal propulsion means.

The vehicle 1 illustrated in FIG. 1 is coupled to one end 2*b* of the pulling cable 2, the other end 2*a* of which is designed to be connected to a recovery device (not shown). FIG. 2 illustrates the vehicle 1 ready to be secured to the ballasted end 2*b* of the pulling cable 2. As a variant, it would be possible to couple a float (not shown) to the pulling cable in order to ensure the verticality of the cable, notably in the context of the recovery of the vehicle by a submersible.

Figure 3:
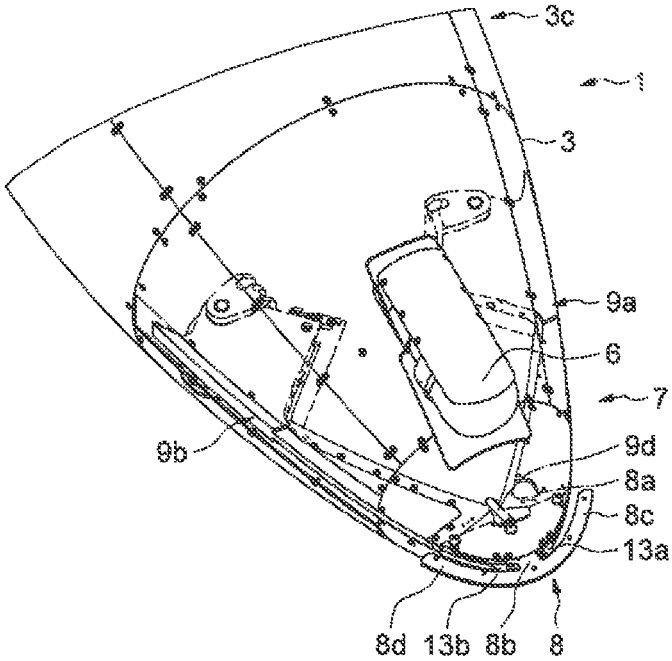
FIGS. 3, 4, 5 represent the front portion of the marine vehicle according to FIG. 1 illustrating various positions of the coupling means.
Figure 4:
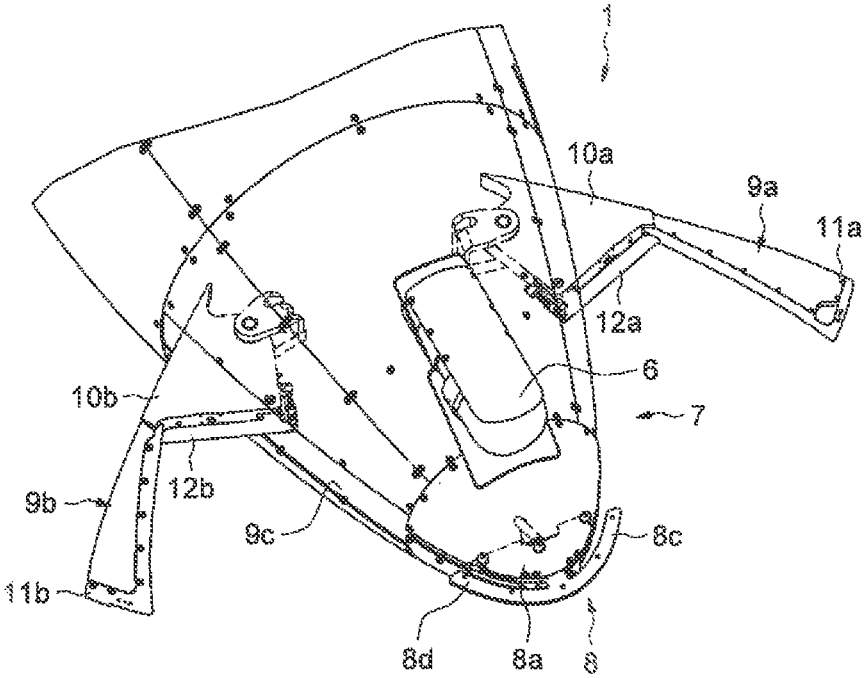
Figure 5:
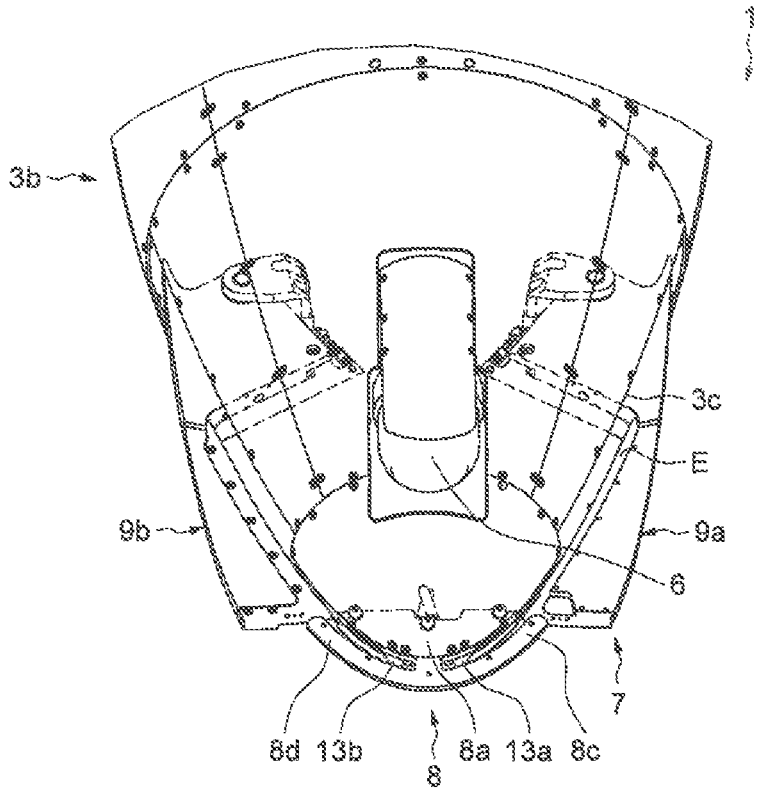

The front portion 3*b* of the vehicle 1, illustrated in detail in FIGS. 3 to 5, comprises contactless detection means 6 for detecting the pulling cable 2, such as a sonar, capable of guiding the vehicle 1 towards the pulling cable 2 and means 7 for coupling the cable 2 that are situated at a front end 3*b* of the vehicle 1. In the example illustrated, the contactless detection means 6 is situated on the upper portion of the vehicle 1, in a housing 6*a* provided for the purpose. The contactless detection means 6 may, for example, be controlled to come out of this housing 6*a* in order to find the pulling cable 2. It will be noted that the contactless detection means could equally be directly attached to the outer surface of the vehicle 1.

The coupling means 7 comprise a set of hooks 8 situated at the end of the front portion 3*b* of the vehicle 1, two grippers 9*a*, 9*b* and two locking clappers 13*a*, 13*b* each situated in a hook 8 for the passage of the cable 2.

The set of hooks 8, for example of the double fishhook type, comprises a base 8*a* of substantially a conical shape closely matching the shape of the end of the front portion 3*b* of the vehicle 1, a rigid rod 8*b* and two curved points 8*c*, 8*d* around the base 8*a*. As a variant, it would be possible to provide for the use of a single curved point 8*c* forming a single fishhook.

The grippers 9*a*, 9*b* are able to rotate between a closed position, that can be seen in FIG. 3, in contact with the outer surface 3*c* of the vehicle, an open position, that can be seen in FIGS. 2 and 4, separating from the outer surface 3*c* of the vehicle 1, and a coupling position, that can be seen in FIGS. 1 and 5, in which each gripper 9*a*, 9*b* interacts with a curved point 8*c*, 8*d* in order to leave a space E for the passage of the cable 2 between each gripper 9*a*, 9*b* and the outer surface 3*c* of the vehicle 1. As a variant, it would be possible to use a single gripper 9*a*.

Each gripper 9*a*, 9*b* comprises a base 10*a*, 10*b* connected to a pivoting mechanism (not shown) comprising for example a set of cylinders, and a portion 11*a*, 11*b* protruding outwards, of generally parallelepipedal shape. The front portion 3*b* of the vehicle 1 comprises grooves 9*c* in which the grippers 9*a*, 9*b* are housed in the closed position that can be seen in FIG. 3. The closed position corresponds notably to a transit position. The portions of the gripper 9*a*, 9*b* situated in the housings 9*c* of the vehicle 1 are illustrated in dashed lines in the figures. A pad 9*d* may be placed inside the vehicle 1 in order to prevent contact between the grippers 9*a*, 9*b* when the latter are in the closed position. Stowing the grippers 9*a*, 9*b* in the housings made for this purpose in the body 3 of the vehicle 1 prevents the grippers 9*a*, 9*b* from becoming coupled to elements during the transit of the vehicle 1.

Each base 10*a*, 10*b* comprises a portion 12*a*, 12*b* for detection by contact of the cable 2.

The vehicle 1 also comprises an electronic control unit (not shown) capable of directing the vehicle 1 towards the pulling cable 2 as a function of the contactless detection means 6, of controlling the position of the grippers 9*a*, 9*b* as a function of the data supplied by the portion for detection by contact 12*a*, 12*b*, and of locking the corresponding clapper 13*a*, 13*b* after the passage of the cable 2.

There is no departure from the context of the invention when the coupling means 7 are situated in a place other than at the front end 3*b* of the vehicle 1; specifically, it would be possible to provide a coupling of the pulling cable 2 for example from the top of the vehicle 1.

The method for coupling the vehicle 1 to a pulling cable 2 is as follows.

In a first step, the vehicle 1 is guided towards the pulling cable 2 by contactless detection means 6, for example of the sonar type.

When the pulling cable 2 is detected by the contactless detection means 6, the grippers 9*a*, 9*b* are actuated simultaneously by the electronic control unit into an open position separating from the outer surface 3*c* of the vehicle 1, as can be seen in FIGS. 2 and 4.

When the pulling cable 2 is detected by one of the means for detection by contact 12*a*, 12*b* situated respectively on a gripper 9*a*, 9*b*, the grippers 9*a*, 9*b* are actuated simultaneously into a coupling position, that can be seen in FIG. 3, in which each gripper 9*a*, 9*b* interacts with a curved end 8*c*, 8*d* in order to leave a space E for the passage of the cable 2 between the gripper 9*a*, 9*b* and the outer surface 3*c* of the vehicle 1.

Once the pulling cable 2 is in the space E between one of the grippers 9*a*, 9*b* and the outer surface 3*c* of the vehicle 1, the propulsion means (not shown), of the vehicle 1 are stopped so that the pulling cable 2 slides towards the rigid rod 8*b* and slips through one of the locking clappers 13*a*, 13*b* situated in the hook 8 up to its ballasted end serving as a stop.

The electronic control unit actuates the locking clapper 13*a*, 13*b* in order to prevent the cable 2 from backing up and thus allows effective locking of the pulling cable 2 by the vehicle 1.

Once the vehicle 1 is coupled to the pulling cable 2, the vehicle 1 is towed, for example with the aid of a winch, into a receiving cage in order to position the front, called the "nose", of the vehicle 1 in a docking means, for example in a movable receiving cone. The vehicle 1 thus housed in the cage can then be raised to the surface. It will be noted that the invention is not limited by the use of such a receiving cage in order to recover the marine vehicle. Any other means for recovering a marine vehicle using a pulling cable may be used.

Moreover, it will be noted that the invention described above may be applied to a single gripper without causing substantial modifications.

By virtue of the invention, the marine or underwater vehicle is capable of being secured autonomously to a pulling cable by effective coupling means providing many advantages such as the possible recovery of the vehicle from any structure, fixed or movable, floating or submerged, having a ballasted cable. The possible recovery of the vehicle underwater makes it possible to operate independently of the influence of the swell.

Moreover, such a coupling device can easily be adapted to existing systems, for example by using a cable fitted with an end ballast, and moreover requires no human intervention in the sea.

The invention claimed is:

1. A marine or underwater vehicle that operationally secures to a recovery cable, said marine or underwater vehicle comprising:

contactless detection means for detecting the recovery cable and guiding the vehicle towards the recovery cable; and a coupling device located on the vehicle that couples to the recovery cable, wherein the coupling device comprises at least one hook and at least one gripper, and wherein the at least one gripper of the coupling device is rotatable between i) a closed position in contact with an outer surface of the vehicle, ii) an open position separating from the outer surface of the vehicle, and iii) a coupling position in which the gripper interacts with the at least one hook such that a space is formed sufficient for passage of the recovery cable between the gripper and the outer surface of the vehicle.

2. The marine or underwater vehicle according to claim 1, wherein the coupling device is located at one end of the vehicle.

3. The marine or underwater vehicle according to claim 1, wherein the at least one gripper comprises a portion that detects the recovery cable by contact.

4. The marine or underwater vehicle according to claim 3, wherein the coupling device comprises at least one locking clapper situated in the at least one hook for passage of the recovery cable.

5. The marine or underwater vehicle according to claim 4, further comprising:

an electronic control unit that directs the vehicle towards the recovery cable as a function of the contactless detection means, controls a position of the gripper as a function of data supplied by the portion that detects the recovery cable by contact, and locks the at least one locking clapper after passage of the recovery cable.

6. The marine or underwater vehicle according to claim 1, wherein the coupling device comprises two grippers.

7. The marine or underwater vehicle according to claim 1, further comprising:

propulsion means.

8. The marine or underwater vehicle according to claim 1, wherein the contactless detection means comprise at least one sensor.

9. A method for coupling a marine or underwater vehicle to a recovery cable, comprising:

detecting the recovery cable and guiding the marine or underwater vehicle to the recovery cable by way of contactless detection means; and coupling the recovery cable by way of a coupling device situated on the marine or underwater vehicle, wherein the coupling device is provided with at least a hook and a rotatable gripper, wherein, when the recovery cable is detected by the contactless detection means, the gripper is actuated into an open position external from the outer surface of the marine or underwater vehicle, and wherein, upon detection of the recovery cable by way of a portion situated on the gripper that detects the recovery cable by contact, the gripper is actuated into a coupling position in which the gripper interacts with the hook in order to form a space sufficient for passage of the recovery cable between the gripper and an outer surface of the vehicle.

10. The coupling method according to claim 9, wherein, when the recovery cable is in the space between the gripper and the outer surface of the vehicle, the recovery cable is allowed to slide towards a locking clapper situated in the hook, and the recovery cable is locked by locking the clapper.

11. A marine or underwater vehicle that operationally secures to a recovery cable , said marine or underwater vehicle comprising:

contactless detection means for detecting the recovery cable and guiding the vehicle towards the recovery cable; and a coupling device located on the vehicle that couples to the recovery cable, wherein the coupling device comprises at least one hook and at least one gripper, and wherein the coupling device comprises at least one locking clapper situated in the at least one hook for passage of the recovery cable.

* * * * *